US010811815B2

(12) United States Patent
Blank et al.

(10) Patent No.: US 10,811,815 B2
(45) Date of Patent: Oct. 20, 2020

(54) PRODUCTION OF A SEALED PLUG BY INJECTING ADHESIVE DURING THE JOINING OF PLUG CONTACTS AND PLUG HOUSING

(71) Applicants: THYSSENKRUPP PRESTA AG, Eschen (LI); thyssenkrupp AG, Essen (DE)

(72) Inventors: Katrin Blank, Satteins (AT); Thomas Ramspeck, Feldkirch (AT); Peter Kenez, Budapest (HU); Friedrich Robert Zacharias, St. Margrethen (CH)

(73) Assignees: THYSSENKRUPP PRESTA AG, Eschen (LI); THYSSENKRUPP AG, Essen (DE)

( * ) Notice: Subject to any disclaimer, the term of this patent is extended or adjusted under 35 U.S.C. 154(b) by 0 days.

(21) Appl. No.: 16/479,979

(22) PCT Filed: Jan. 24, 2018

(86) PCT No.: PCT/EP2018/051659
§ 371 (c)(1),
(2) Date: Jul. 23, 2019

(87) PCT Pub. No.: WO2018/138118
PCT Pub. Date: Aug. 2, 2018

(65) Prior Publication Data

US 2019/0348796 A1 Nov. 14, 2019

(30) Foreign Application Priority Data

Jan. 27, 2017 (DE) ..... 10 2017 000 722

(51) Int. Cl.
*H01R 13/52* (2006.01)
*H01R 43/00* (2006.01)

(52) U.S. Cl.
CPC ..... *H01R 13/5216* (2013.01); *H01R 43/005* (2013.01); *H01R 2201/26* (2013.01)

(58) Field of Classification Search
CPC ..... H01R 13/5216; H01R 13/5219; H01R 43/005; H01R 43/007; H01R 2201/26
See application file for complete search history.

(56) References Cited

U.S. PATENT DOCUMENTS 5,518,415 A * 5/1996 Sano ..... H01R 13/521 439/204
6,461,027 B1 * 10/2002 Yagi ..... H01R 33/09 362/505

(Continued)

FOREIGN PATENT DOCUMENTS

CN 101964478 A 2/2011
CN 103718389 A 4/2014

(Continued)

OTHER PUBLICATIONS

English Translation of International Search Report issued in PCT/EP2018/051659, dated Apr. 4, 2018.

*Primary Examiner* — Oscar C Jimenez
(74) *Attorney, Agent, or Firm* — thyssenkrupp North America, LLC

(57) ABSTRACT

A plug for an electrical connector arrangement may include a plug contact arranged in a socket on one side and in a plug housing on the other side. The plug housing may be cup-shaped and include a base with a region that projects downward as a connecting part. In the region of the connecting part, a cut-out may pass through the base via which the plug contact is guidable. The plug contact may be positioned in the socket with a recess. The plug contact may be connected to the socket in the recess, and the connecting part of the plug housing may be adhesively bonded in the recess of the socket such that the plug contact is sealed (Continued)

against dirt and moisture in the region of the cut-out relative to the plug housing.

15 Claims, 3 Drawing Sheets

(56) References Cited

U.S. PATENT DOCUMENTS

| | | | | |
|---|---|---|---|---|
| 9,505,427 | B2 | 11/2016 | Fujimoto | |
| 2015/0244097 | A1* | 8/2015 | Hirayama | G01L 19/0084 439/660 |
| 2015/0372413 | A1* | 12/2015 | Kataoka | H01R 13/5219 439/271 |
| 2017/0025784 | A1* | 1/2017 | Greene | H01R 43/20 |
| 2018/0257274 | A1* | 9/2018 | Bucco | F16J 15/102 |
| 2018/0358738 | A1* | 12/2018 | Janse | H01R 31/065 |
| 2019/0013616 | A1* | 1/2019 | Huang | H01R 13/746 |
| 2019/0052012 | A1* | 2/2019 | Chen | H01R 13/5219 |
| 2019/0067868 | A1* | 2/2019 | Cairns | F16J 15/40 |
| 2019/0097375 | A1* | 3/2019 | Naka | H01R 13/504 |
| 2019/0172607 | A1* | 6/2019 | Bilas | H01R 12/592 |
| 2019/0217730 | A1* | 7/2019 | Gotz | H01R 13/5202 |
| 2019/0380220 | A1* | 12/2019 | Matsuda | H05K 5/062 |

FOREIGN PATENT DOCUMENTS

| | | | |
|---|---|---|---|
| DE | 102015101791 | A | 8/2015 |
| DE | 102016212758 | A | 1/2017 |
| EP | 2814117 | A | 12/2014 |
| JP | 2001068206 | A | 3/2001 |

* cited by examiner

PRODUCTION OF A SEALED PLUG BY INJECTING ADHESIVE DURING THE JOINING OF PLUG CONTACTS AND PLUG HOUSING

CROSS REFERENCE TO RELATED APPLICATIONS

This application is a U.S. National Stage Entry of International Patent Application Serial Number PCT/EP2018/051659, filed Jan. 24, 2018, which claims priority to German Patent Application No. DE 10 2017 000 722.5, filed Jan. 27, 2017, the entire contents of both of which are incorporated herein by reference.

FIELD

The present disclosure generally relates to plugs for electrical connector arrangements as well as to methods for assembling such plugs.

BACKGROUND

Electromechanical motor vehicle servo steering mechanisms comprise servo units, which can be arranged as a power assistance device on a pinion or a rack of the steering gear. The servo unit comprises an electronic control unit for the calculation of steering assistance. The electronic control unit is connected to an electrical connector arrangement. The latter comprises terminals for the supply of electric power and for the transmission of information. The terminals each comprise a plug, which is composed of a plug housing and plug contacts. In order to protect the control unit against the ingress of dust and water spray, the plug contacts should be sealed from the exterior, even where no mating connector or socket is fitted thereto. Customarily, to this end, a molding compound is applied around the plug contacts, on the base of the plug housing. The molding compound must be sufficiently fluid to also flow between the plug contacts, and must be susceptible to rapid and reliable curing. If the molding compound is only cured by cross-linking, with no additional acceleration, the process is slow, and prevents any rapid further processing of the molded plugs. If curing is accelerated, e.g. by heat or UV radiation, problems arise in process management, e.g. associated with shadows cast by the plug contacts on the molding compound, or excessive heat-up of the plug housing.

From patent document U.S. Pat. No. 9,505,427 B2, a plug housing is known, wherein a sealing means is arranged in the interior of the housing which, by the action of gravity on an inclined plane of the base of the plug housing, is distributed around the plug contacts. This solution is disadvantageous, in that the sealing material must be sufficiently fluid to permit the distribution thereof. Moreover, the plug cannot undergo any immediate further processing, as the molding compound must firstly be cured. It is further disadvantageous that an inclined base surface cannot reliably ensure that the plug contacts are entirely enclosed in the molding compound.

Thus a need exists for an improved sealing of a plug in an electrical connector arrangement, even where no mating connector is fitted.

DETAILED DESCRIPTION

Figure 1:
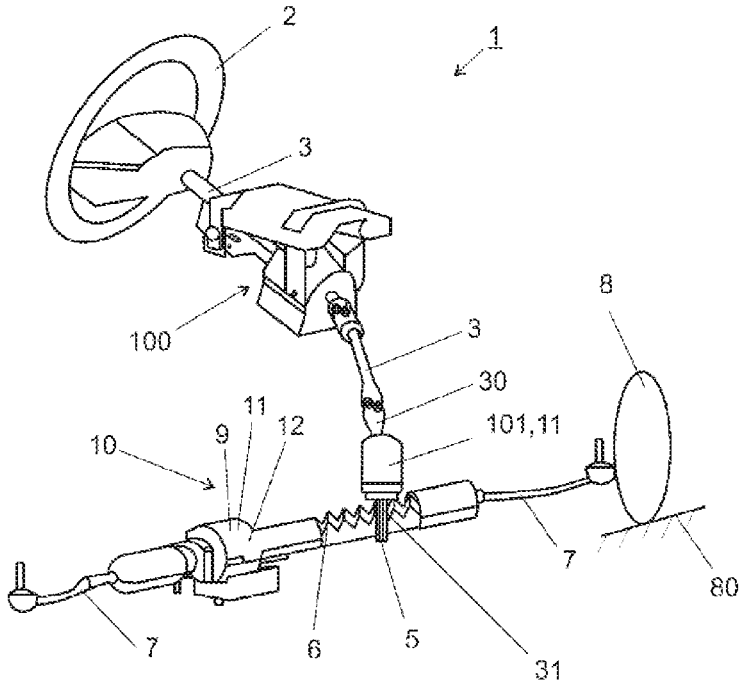
FIG. 1 is a schematic perspective view of an example electromechanical servo steering mechanism.
Figure 2:
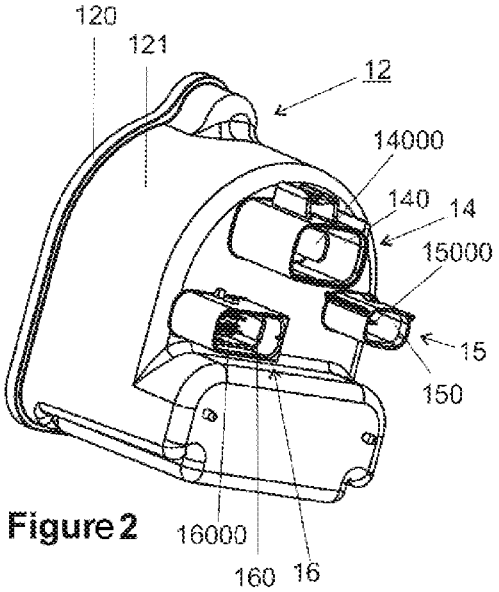
FIG. 2 is a perspective view of an example control unit.
Figure 3:
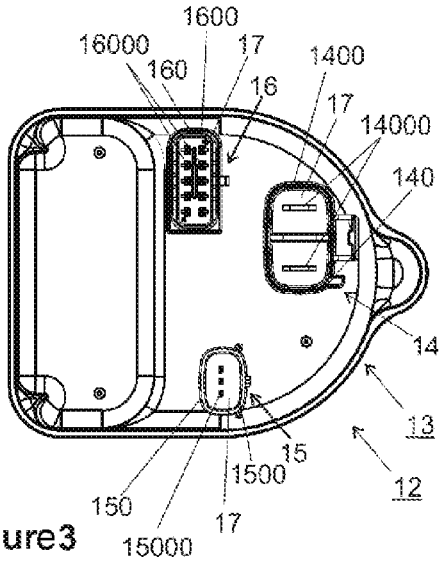
FIG. 3 is a top view of the example control unit.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

Accordingly, a plug for an electrical connector arrangement is provided, comprising at least one plug contact which is arranged in a socket on one side, and in a plug housing on the other side, wherein the plug housing is cup-shaped and comprises a base, comprising a region which projects downward as a connecting part and, in the region of the connecting part, at least one cut-out passing through the base, via which the at least one plug contact can be guided, wherein the plug contact is arranged in the socket with a recess, wherein the plug contact is connected to the socket in the recess, and the connecting part of the plug housing is adhesively bonded in the recess of the socket, such that the at least one plug contact and/or the socket is/are sealed against dirt and moisture, in the region of the cut-out, in relation to the plug housing. This plug comprises superior sealing between the plug contacts, the socket and the plug housing of a plug in an electrical connector arrangement, and prevents any ingress of dirt, moisture or water spray into the plug. Even where a mating connector is fitted, the plug contacts prevent the ingress of foreign bodies.

A plug can comprise a plug housing and a socket, wherein the respective plug housing is an element of a preferably one-piece housing section, for example the housing cover, and comprises plug contacts.

By the plug-in arrangement of the plug contacts in the plug housing, and the subsequent embedding of the plug contacts in adhesive in the recess of the socket, the plug contacts, the socket and the plug housing are securely bonded to one another by means of the adhesive, and the entire plug is simultaneously sealed.

Preferably, the number of cut-outs is matched to the number of plug contacts, such that each plug contact is fed through an associated cut-out. It is further preferred if the cut-out tapers toward the interior of the plug housing, in the direction of the base of the plug housing, and thus away from the projecting region of the base. It can thus be ensured that the adhesive encloses the plug contacts in the cut-out, and fills the latter at least to a certain degree. In one form of embodiment, the cut-outs are partially funnel-shaped, and thereafter comprise an essentially constant cross-section, such that the adhesive can enter the funnel in a simple manner.

Preferably, the base in the region of the connecting part is configured to at least double the thickness of the remainder of the region. The cut-outs which penetrate the base thus assume a certain size or depth, which is advantageous, in that it facilitates the insertion of the plug contacts into the plug housing, and ensures the centring of the contacts.

Preferably, the quantity of adhesive is dimensioned such that the socket, at its upper side, is arranged in line with the underside of the base of the plug housing. The upper side of the socket describes a region around the recess, and the underside of the base constitutes a region of the connecting part in the region around the recess.

It is advantageous if the socket only partially encloses the at least one plug contact, preferably with the plug in the assembled state.

An electrical control unit of an electromechanical motor vehicle servo steering mechanism having at least one above-mentioned plug is also provided.

A method for assembling a plug for an electrical connector arrangement is further provided, wherein the plug comprises at least one plug contact, a socket and a cup-shaped plug housing, and the method comprises the following process steps:

Introduction of adhesive into a recess in the socket, in which the socket is connected to the at least one plug contact;

Connection of the plug housing and the socket such that the base of the plug housing is at least partially introduced into the recess, and the at least one plug contact penetrates the base of the plug housing through a corresponding cut-out in the base, and the at least one plug contact, the socket and the plug housing are adhesively bonded to one another, such that the at least one plug contact and/or the socket, in the region of the cut-out, is/are sealed against dirt and moisture with respect to the plug housing.

The cut-outs or channels constitute an expansion space for the adhesive during the joining process. These cut-outs are thus filled with the adhesive, at least to a certain height.

Preferably, the cut-outs taper from the outside inward, i.e. in the direction of the base of the plug housing and away from the socket, and each is configured to accommodate a single plug contact.

It is advantageous if the socket only partially encloses the plug contacts, preferably with the plug in the assembled state.

Preferably, the quantity of the adhesive introduced is dimensioned such that, upon the joining of the plug housing and the socket with the at least one plug contact, the adhesive does not project, or only slightly projects beyond the edge of the socket. It is further advantageous if the cut-outs are dimensioned such that they can accommodate the adhesive introduced. Accordingly, the base comprises to a corresponding depth.

In one advantageous form of embodiment, the socket itself is configured to a cup-shaped design, and the at least one plug contact penetrates the base of the socket.

Preferably, in the assembled state of the plug, the socket, at its upper side, is arranged in line with the underside of the base of the plug housing.

A plug is further provided for an electrical connector arrangement for an electrical control unit of an electromechanical motor vehicle servo steering mechanism produced by an above-mentioned method.

FIG. 1 shows a schematic representation of an electromechanical motor vehicle servo steering mechanism 1 with a steering wheel 2, which is coupled to a steering column 3 in a rotationally fixed manner. Via the steering wheel 2, the driver applies a corresponding torque to the steering column 3, by way of a steering command. This torque is then transmitted via the steering column 3 to a steering pinion 5. The pinion 5 engages, in a known manner, with a toothed segment of a rack 6. The rack 6 is mounted in a steering housing for displacement in the direction of its longitudinal axis. At its free end, the rack 6 is connected to tie rods 7 via unrepresented ball joints. The tie rods 7 themselves, in a known manner, are each connected via journals to a steered wheel 8 of the motor vehicle. A rotation of the steering wheel 2, via the connection of the steering column 3 and the pinion 5, results in a longitudinal displacement of the rack 6, and thus in a pivoting of the steered wheels 8. The steered wheels 8 are subject to a reaction from the carriage-way 80, which counteracts the steering movement. In order to pivot the wheels 8, a force is therefore required which necessitates the application of a corresponding torque to the steering wheel 2. An electric motor 9 of a servo unit 10 is provided, in order to support the driver in the execution of this steering movement.

The steering column 3 comprises an input shaft 30 which is connected to the steering wheel 2, and an output shaft 31 which is connected to the steering pinion 5. The input shaft 30 and the output shaft 31 are mutually coupled, in a rotationally elastic manner, by means of an unrepresented torsion rod. A torque sensor unit 11 detects the rotation of the input shaft 30 in relation to the output shaft 31 as a measure of the manual torque applied to the steering column 3 or the steering wheel 2. Depending upon the torque measured by the torque sensor unit 11, the servo unit 10 delivers power steering assistance to the driver. The servo unit 10 can thus be coupled, as a power assistance device 10, 100, 101 either to a steering column 3, to the steering pinion 5 or to the rack 6. The respective power assistance device 10, 100, 101 delivers an assistance torque to the steering column 3, the steering pinion 5 and/or the rack 6, as a result of which the driver is supported in the work of steering. The three different power assistance devices 10, 100, 101 represented in FIG. 1 indicate alternative positions for the arrangement thereof. Customarily, only one of the positions indicated is occupied by a power assistance device. For the calculation of steering assistance, the servo unit 10 comprises an electronic control unit 12. The servo unit 10 has a housing, composed of a first housing section, in which the electric motor 9 is arranged, and a second housing section, composed of a housing base 120 and a housing cover 121, in which the control unit 12, with an electrical connector arrangement 13, is arranged. The housing sections 120, 121 are permanently attached to one another, and seal the components arranged therein from the exterior. The housing sections 120, 121 can be formed of aluminum or plastic, preferably of a glass fiber-reinforced or a carbon fiber-reinforced plastic.

The electrical connector arrangement 13, as represented in FIGS. 2 to 5, comprises a first terminal 14 for the supply of electric power to the control unit 12, a second terminal 15 for the communication of the control unit 12 with the vehicle, and a third terminal 16 for the transmission of information from the torque sensor unit 11 to the control unit 12. The terminals 14, 15, 16 each constitute a plug, comprising a plug housing 140, 150, 160, and a socket 1400, 1500, 1600, wherein the respective plug housing 140, 150, 160 is an element of the one-piece housing section 121 and comprises plug contacts 14000, 15000, 16000. The electrical connector arrangement 13 is electrically connected to the electrical control unit 12 by the plugging of the plug contacts 14000, 15000, 16000 into corresponding openings, or the terminals 14, 15, 16 are constituted by the joining of the second housing section 120 with the electrical connector arrangement. Hereinafter, the sections of the respective plug housing 140, 150, 160 are designated as a plug housing.

Figure 4:
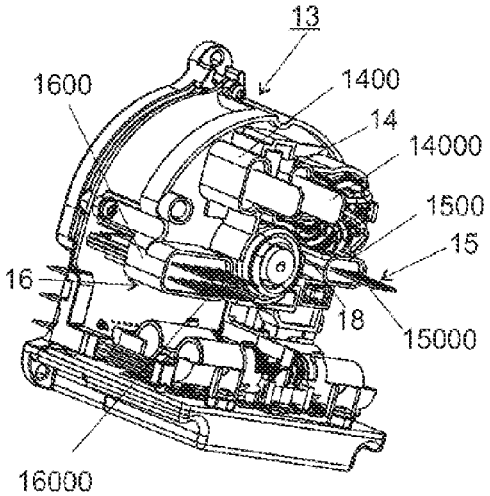
FIG. 4 is a perspective view of the example control unit with an electrical connector arrangement according to FIG. 2, without housing.
Figure 5:
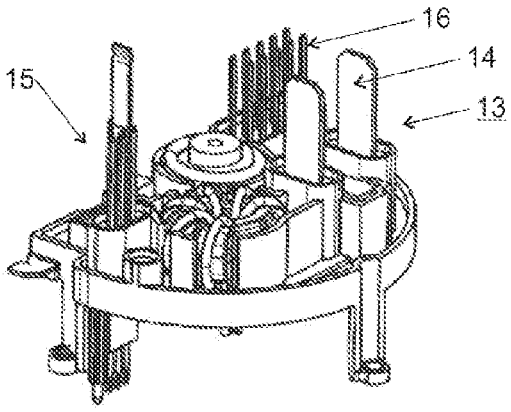
FIG. 5 is an enlarged perspective view of the example electrical connector arrangement, without housing.
Figure 6:
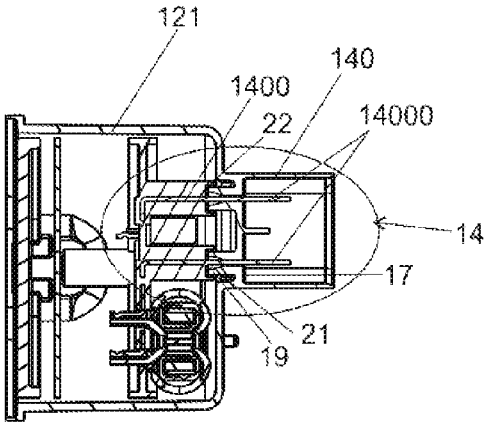
FIG. 6 is a longitudinal sectional view of a first terminal from FIG. 3.
Figure 6A:
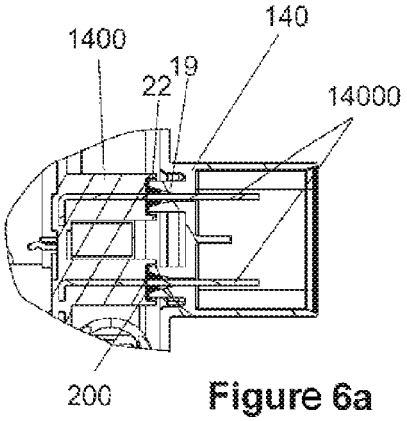
FIG. 6*a* is an enlarged view of an example adhesively bonded plug contact of the first terminal from FIG. 6.
Figure 7:
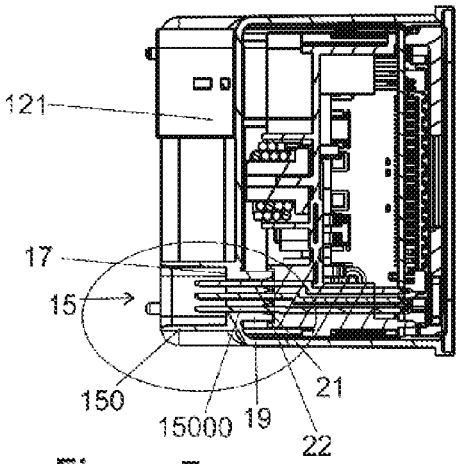
FIG. 7 is a longitudinal sectional view of a second terminal from FIG. 3.
Figure 7A:
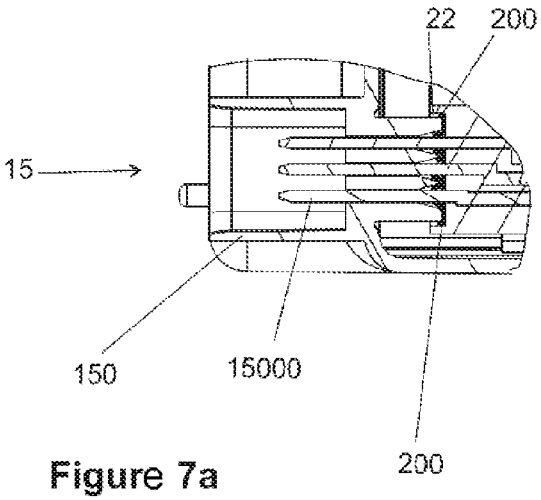
FIG. 7*a* is an enlarged view of an example adhesively bonded plug contact of the second terminal from FIG. 7.
Figure 8:
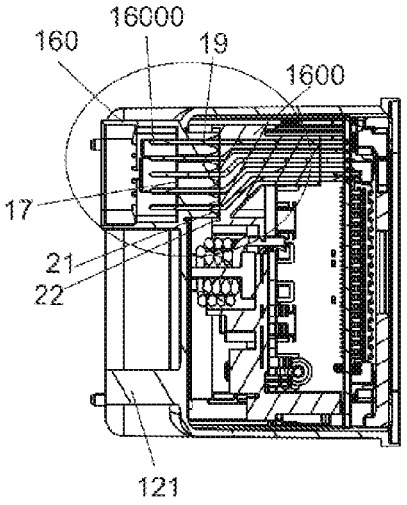
FIG. 8 is a longitudinal sectional view of a third terminal from FIG. 3.
Figure 8A:
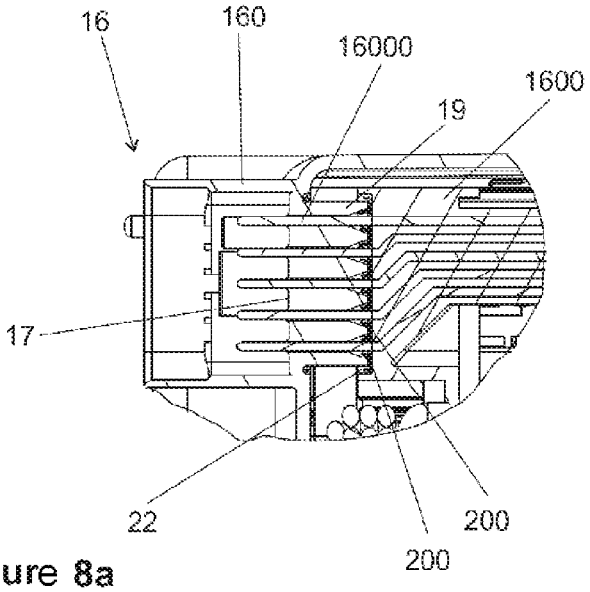
FIG. 8*a* is an enlarged view of an example adhesively bonded plug contact of the second terminal from FIG. 8.
Figure 9:
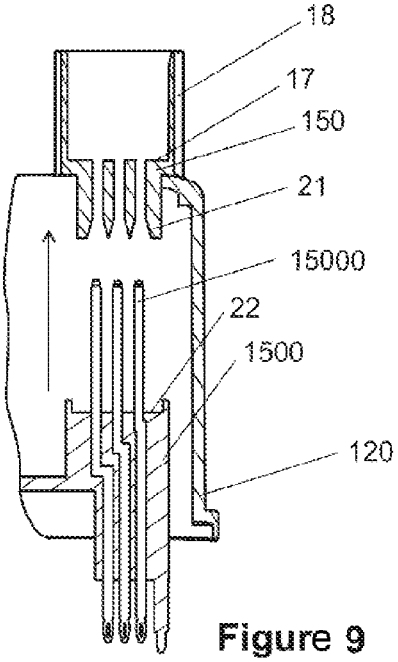
FIG. 9 is a partial cross-sectional view of the control unit from FIG. 2 and a representation of the insertion of the plug contacts into the plug housing.
Figure 10:
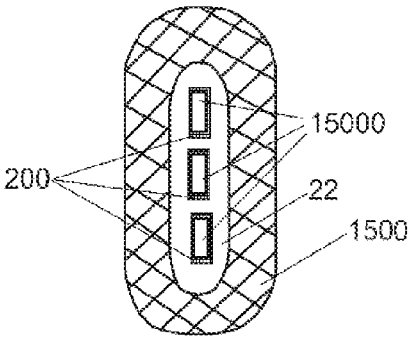
FIG. 10 is top view of the inserted and bonded plug contacts from FIG. 7 in an electrical connector arrangement.

The plug housings 140, 150, 160 are approximately rectangular boxes. A plug housing 140, 150, 160 of this type is represented in FIGS. 6 to 8*a*. The plug housing 140, 150, 160 is open at its top and bottom ends, and is configured with a base 17. The outer wall of the plug housing 150, as represented in FIG. 4, can comprise webs 18 for the prevention of rotation. The base 17 comprises a downwardly-projecting region 19 which, as a connecting part, can engage in a socket 1400, 1500, 1600 which is connected to the plug contacts 14000, 15000, 16000. The base 17, in the region of the connecting part 19, is penetrated by cut-outs 21, through which each of the plug contacts 14000, 15000, 16000 can be individually routed into the plug housing 140, 150, 160. These cut-outs 21 or channels incorporate a downward funnel-shaped extension.

As represented in FIGS. 5 to 10, the plug contacts 14000, 15000, 16000 are connected to the socket 1400, 1500, 1600. The socket 1400, 1500, 1600 comprises a recess 22, in which the plug contacts 14000, 15000, 16000 are arranged. The plug contacts 14000, 15000, 16000 project beyond the upper side of the socket 1400, 1500, 1600, or the socket only partially encloses the plug contacts. The recess 22 corresponds to the connecting part 19 of the plug housing 140, 150, 160, which is insertable in the recess 22. The socket 1400, 1500, 1600 is configured by plastic being molded around the plug contacts 14000, 15000, 16000. Accordingly, a connection is further created between the plug contacts 14000, 15000, 16000 and the socket 1400, 1500, 1600, as a result of which no adhesive is required for the permanent connection. The socket can be molded, such that the latter is configured to a cup shape.

For the connection of the plug housing 140, 150, 160 with the plug contacts 14000, 15000, 16000, as represented in FIGS. 6*a*, 7*a*, 8*a*, 10, the plug housing 140, 150, 160 with its respective connecting part 19, is joined to the respective socket 1400, 1500, 1600, such that the tapering cut-outs 21 of the connecting part 19 are arranged in the recess 22 of the socket. The plug contacts are inserted in the plug housing 140, 150, 160. Thereafter, the plug contacts 14000, 15000, 16000 in the recess 22 of the socket 1400, 1500, 1600 are embedded in adhesive 200. The quantity of adhesive is dimensioned such that the adhesive 200, upon the joining of the plug housing 140, 150, 160 to the plug contacts, does not escape or spill over the socket, and the adhesive enters the tapering cut-outs 21 in the base 17 of the plug housing, wherein it encloses the plug contacts. Upon the interlocking of the two plug elements, the sealing material 200 or the adhesive is automatically compressed into the correct position in the plug housing and the socket. By means of the adhesive, the plug contacts, the socket and the plug housing are permanently bonded to one another, and the entire plug is simultaneously sealed. It is not necessary for the adhesive to have a particularly liquid quality. The adhesive is preferably stable, easy to apply, can bond materials of different types and simultaneously constitutes a seal against dirt and moisture. A suitable adhesive 200, for example, is a single-component silicone adhesive or a two-component silicone adhesive, or further adhesives which, by the application of a specific force, can enter the funnel-shaped cut-outs in the plug housing, can be compressed into the recess and can be cured therein.

As represented in the figures, it can preferably be provided that the terminals 14, 15, 16 are an element of the electronic connector arrangement 13, as a result of which new options for design and assembly are provided. As there is no separate plug unit to be connected to the remainder of the subassembly, the design can be configured to a significantly more compact arrangement. Moreover, any subsequent sealing can be omitted, thereby obviating an entire process step, if the joining of the plug can be integrated in another joining process.

What is claimed is:

1. A plug for an electrical connector arrangement, comprising a plug contact that is disposed in a socket on a first side and in a plug housing on a second side, wherein the plug housing is cup-shaped and includes a base having a region that projects downward as a connecting part, wherein in the region of the connecting part a cut-out passes through the base via which the plug contact is guidable, wherein the plug contact is disposed in the socket with a recess, wherein the plug contact is connected to the socket in the recess, wherein adhesive adhesively bonds the connecting part of the plug housing only within the recess of the socket such that the plug contact is sealed against dirt and moisture in the region of the cut-out relative to the plug housing, wherein the adhesive is limited to the recess and spaced apart from the base aside from the connecting part.

2. The plug of claim 1 wherein the cut-out tapers toward an interior of the plug housing.

3. The plug of claim 1 wherein the cut-out is partially funnel-shaped and comprises a substantially constant cross-section.

4. The plug of claim 1 wherein the base in the region of the connecting part is configured to have a thickness that is at least double a thickness of a remainder of the region.

5. The plug of claim 1 wherein an upper side of the socket is disposed in line with an underside of the base of the plug housing.

6. The plug of claim 1 wherein the socket only partially encloses the plug contact.

7. The plug of claim 1 wherein the socket is cup-shaped, wherein the plug contact penetrates the base.

8. The plug of claim 1 wherein the plug housing is an element of a one-piece housing section.

9. An electrical control unit of an electromechanical motor vehicle servo steering mechanism that comprises the plug of claim 1.

10. A method for assembling a plug for an electrical connector arrangement, wherein the plug comprises a plug contact, a socket, and a plug housing, the method comprising:

introducing adhesive into a recess in the socket in which the socket is connected to the plug contact, wherein an amount of the adhesive that is introduced is dimensioned such that upon joining the plug contact, the plug housing, and the socket, the adhesive does not project out of the recess of the socket; and connecting the plug housing, which is cup-shaped, and the socket such that a base of the plug housing is at least partially introduced into the recess, wherein the plug contact penetrates the base of the plug housing through a corresponding cut-out in the base, wherein the plug contact, the socket, the plug housing are adhesively bonded to one another, such that the plug contact in the region of the corresponding cut-out is sealed against dirt and moisture with respect to the plug housing.

11. The method of claim 10 wherein the corresponding cut-out tapers from an outside inward and is configured to accommodate only the plug contact.

12. The method of claim 10 wherein the socket only partially encloses the plug contact.

13. The method of claim 10 wherein the amount of the adhesive that is introduced is dimensioned such that upon joining the plug contact, the plug housing, and the socket, the adhesive does not project beyond an upper edge of the recess of the socket.

14. The method of claim 10 wherein in an assembled state of the plug, an upper side of the socket is aligned with an underside of the base of the plug housing.

15. A plug for an electrical connector arrangement for an electrical control unit of an electromechanical motor vehicle servo steering mechanism produced by the method of claim 10.

* * * * *